US005636489A

United States Patent [19]

Leverrier et al.

[11] Patent Number: 5,636,489

[45] Date of Patent: Jun. 10, 1997

[54] COMPOSITE MATERIAL FACINGS FOR WALL COVERINGS

[75] Inventors: Thierry Leverrier, Torce en Vallee; Jean Favreau, Paris, both of France

[73] Assignee: Societe Civile Neurone, France

[21] Appl. No.: 443,065

[22] Filed: May 17, 1995

[30] Foreign Application Priority Data

May 20, 1994 [FR] France ..... 94 06422

[51] Int. Cl.[6] ..... E04D 1/28; E04C 2/296

[52] U.S. Cl. ..... 52/540; 52/309.8; 52/521

[58] Field of Search ..... 52/309.1, 309.9, 52/309.14, 309.8, 521, 527, 533, 540

[56] References Cited

U.S. PATENT DOCUMENTS

| | | | |
|---|---|---|---|
| 4,052,831 | 10/1977 | Roberts et al. | 52/309.8 |
| 4,453,357 | 6/1984 | Zwilgmeyer | 52/309.8 |
| 4,765,107 | 8/1988 | Ting | 52/235 |
| 4,788,808 | 12/1988 | Slocum | 52/309.8 X |
| 5,218,798 | 6/1993 | Bentivegna et al. | 52/309.8 X |
| 5,271,878 | 12/1993 | Mizia et al. | 52/309.14 X |
| 5,329,741 | 7/1994 | Nicolaidis et al. | 52/309.8 X |

*Primary Examiner*—Michael Safavi
*Attorney, Agent, or Firm*—Harrison & Egbert

[57] ABSTRACT

A composite material facing that can be used in the building industry to achieve a wall facing cover including a high pressure polymerized polyester molded outer facing, and expanded polystyrene panel bonded behind the outer facing, a top edge back-set interlock having a groove which engages a tongue located in a lower edge of the adjacent facing, an invisible facing securing member extending through the insulating panel and located at a top edge of the facing in a back-set area concealed by a fitting of an adjacent facing, and the insulating panels for each facing being butted end-to-end without assembly. The interlock insures satisfactory flatness of the cover and reduces defects in the support.

5 Claims, 2 Drawing Sheets

COMPOSITE MATERIAL FACINGS FOR WALL COVERINGS

TECHNICAL FIELD

The present invention relates to a composite material facing for the purpose of wall covering applications.

It is applicable in the field of the building industry where new wall coverings are required, or the repair and consolidation of existing wall faces while still allowing external or internal access.

BACKGROUND ART

The wall cover is for instance known as facing when applied to an existing support. Facings are generally fitted directly to any rough or coated, flat and vertical supports, though in the event of poor flatness of such supports, a skeleton may be installed to which the composite material facing can be secured. In case of an interposed skeleton, reference is no longer made to a facing but to a cladding of the building by means of a wall insulating cover.

These covers generally always have two main functions, thermal insulation and impermeability, whether applied to new buildings or the renovation of old buildings.

Among the facings known today, although results are achieved in the matter of thermal insulation material, numerous inconveniences exist particularly with regard to the ease of installation on site since such facings include securing means to the wall, generally, of a complex nature, executed by means of rails to which hooks are fitted allowing the installation of the various cover components to the rail or in the manner of tiles on a roof. Tee-sections may also be used. In addition to installation difficulties, these facings have a further important inconvenience: they are not aesthetic in appearance since all the external hooks are visible and very prominent. The hooks may be damaged or ripped away.

Among the existing facings there are numerous installation possibilities. Wall insulating facings available on the market today consist of several components which have to be drawn, designed, manufactured and stored according to the type of facing used or according to the area of facing thus constructed.

Bearing in mind that with these securing means by rails or hooks, the known facings made up by the assembly of various facing components, generally have poor poor wateproofing features and to achieve a seal it is necessary to use seals which are eventually destined to deteriorate.

It is also necessary for the materials thus used to have a sufficient impact resistance and to present self washable qualities allowing the faces of graffiti applied for instance by means of paint aerosols to be removed.

Facings or claddings have already been designed today consisting of an external cover produced in a natural or synthetic material. To this cover is applied an insulating panel of sufficient thickness, for instance a few centimeters to several tenth of centimeters. The insulating panels most frequently used are generally made of expanded polystyrene bonded behind the external facing.

In the known facings, the insulating expanded polystyrene panels are cut out along their periphery to join the adjacent panel. This provision is necessary bearing in mind securing systems in use but it sometimes presents a problem in the sense that it may cause excessive thickness and facing flatness defects along the whole of the wall facing.

External facings have a flat surface but when applied with known devices for wall insulation facings, it is found that differences, sometimes considerable, exist in flatness compared with adjacent panels. In certain areas considerable flatness defects are commonly seen and this is all the more inconvenient that on observing from the base of the wall and looking upwards the eye easily detects them in a glancing light.

The purpose of the present invention is to remedy such inconveniences and for that purpose, one of the initial aims is to provide a composite material facing which can be used in the construction industry to provide a wall facing, of easy manufacture since the number of components forming the facing is reduced to a minimum. All the insulation, joining, securing and drainage functions are concentrated in each facing component forming the wall insulating cover and a single type of component may be used.

The installation of such a composite material facing is thus facilitated, whether it be a matter of a cover secured to an existing support or cladding to secured to a fired support. The installation is very easy since the structure is simple ad the securing means do not call for rails secured to the wall, nor hooks fitted to the facing secured to the rail.

Another purpose of the composite material facing which may be used in the building industry to achieve a wall facing cover according to the invention is to ensure very good weatherproofing and protection of the facing from rainwater collected on the outer face of the facing or with regard to condensation water on the internal face turned towards the building.

Another purpose of the composite material facing which may be used in the building industry to achieve a wall facing cover according to the invention is to ensure a good impact resistance. The condition of the facing surface will also have good resistance properties and will preferably by rot-proof and self-washable.

Another advantage of the composite material facing used for facing a wall according to the invention is that the connecting means have a greatly reduced surface and volume and are thus hidden by adjacent facings. The external surface finish of the facing formed by a multitude of facings is thus an excellent flatness and a perfect very flat finish, without asperities nor hooks.

Another feature of the composite material facing which may be used in the building industry to achieve a wall facing cover according to the invention is that the facing connecting means are integral with the strong outer faces and do not stress the thicker expanded polystyrene insulating panel which has a lower strength.

Another purpose of the composite material facing which may be used in the building industry to achieve a wall facing cover according to the invention is to achieve an excellent flatness by means of expanded polystyrene insulating panels brought together end to end without assembly nor interpenetration of the panels one into the other.

Another advantage of the composite material facing which may be used in the building industry to achieve a wall facing cover according to the invention is that each outer facing, when interlocked into the four adjacent facings, has a strictly flat surface without projection nor defect. The contiguous surfaces of all adjacent faces are as close as possible to each other to improve insulation and impermeability to rainwater in the vertical or horizontal facing join zones.

Another purpose of the composite material facing to achieve a wall cover is to utilise insulating panel blocks uncut at their periphery to achieve the connection, which gives a far better insulation and better connection of facings.

A further advantage of the composite material facing to achieve a wall cover is to provide connecting means and an outer cover with insulating panels brought together end to end allowing the building of a wall with a visible flat material external surface and a minimal surface for the joins between each facing, which is useful particularly from the aesthetic and the insulation viewpoints.

SUMMARY OF THE INVENTION

The present invention relates to a composite material facing which may be used in the building industry to achieve a wall facing such as a cover when secured to an existing support or a cladding when secured to a fitted support comprising:

an external, rot-proof, self-washable, moulded polyester high-pressure polymerised facing, an expanded polystyrene panel bonded behind the outer facing, charaeterised by the fact that it comprises:

top edge back-set connecting means consisting of a groove in which engages a tongue located on the lower edge of the adjacent facing, these engaging means ensuring good flatness of the cover and reducing support defects, facing invisible securing means through the insulating panel, without rail nor hook, located on the top edge of the facing in a back-set area made invisible by the fitting of the adjacent facing, the insulating panels for each facing being brought together end to end without assembly to ensure better flatness of the facing all along the wall frontage.

DETAILED DESCRIPTION OF THE INVENTION

Figure 1:
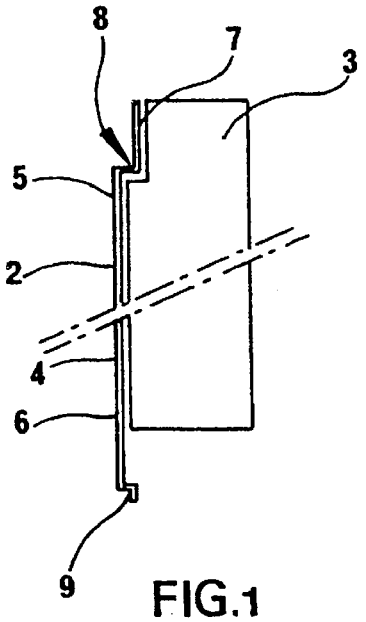
FIG. 1 is a vertical section through a composite material facing component according to the invention.

The insulating cover according to the invention is achieved from small prefabricated components, associating a moulded outer facing made for instance of HDC "high durability compound" polyester and a machined insulating panel made either of polystyrene, or rock wool.

Each facing is associated with adjacent facings by engaging in top and bottom traverses and is secured to the carrier structure by means of metal fasteners passing through placed at the top edges and of which the heads are hidden by the overhang of upper facings.

The facing may be used to achieve the insulated facing of a vertical wall or roofing.

The selected polyester compound will have high durability properties and will be rot-proof and self-washable. Good results have been obtained by high pressure and high temperature polymerisation of a polyester compound made up as follows:

polyester resin 18 to 23% fibreglass 7 to 10% mineral fillers 60 to 70% pigment and additions particularly for turning out of the mould and to give the product all required colour shades.

According to the qualities required of the facing, the thickness of the high pressure polymerised outer facing may be of a few millimeters. If that thickness is not sufficient to ensure good impact resistance, it can then be reinforced for instance in the exposed areas by means of glass clothe applied before moulding the polyester.

The facing according to the invention may naturally be produced in several sizes but it will always preferably of the same structure and same shape, to facilitate manufacture and installation.

The polyester may naturally be replaced by any other thermosetting resin which may be adapted to the application.

It may for instance be a non-saturated polyester resin.

The weight per square meter of standard component, for the use of a cover with a usual thickness of insulation, for instance 60 mm is reasonable since it comes between 8 and 10 kg.

The facing according to the invention also has excellent insulation properties as well as good waterproofing properties. The results are obtained by means of engaging means specific to the invention and by the drainage network used to collect rainwater or condensation water.

The covers according to the invention may be placed directly on all types of rough or coated, flat and vertical supports and in the event of poor flatness, on a skeleton fitted for cladding operations.

The surface result obtained is very good, allowing maintenance to be reduced to the minimum. The facings are self-washable.

If a component is damaged, the invention also allows replacement of an isolated component without dismantling adjacent components.

Figure 2:
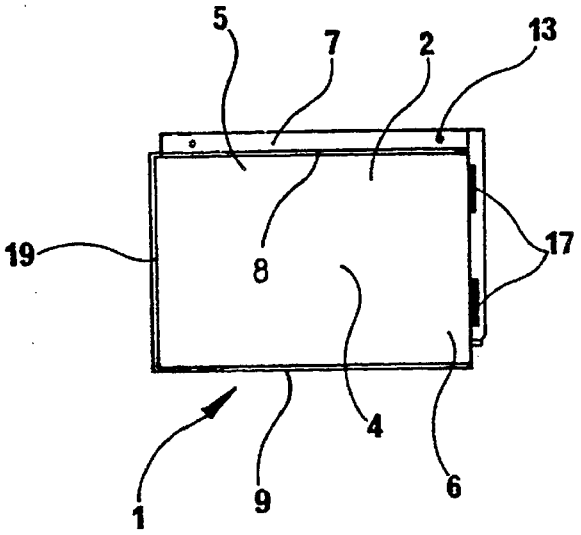
FIG. 2 is a front view of a rectangular shaped component.
Figure 3:
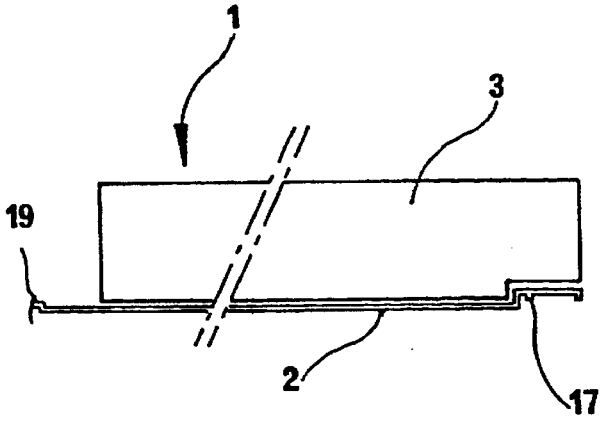
FIG. 3 is an horizontal section through the composite material facing according to the invention.

By reference to FIGS. 1 to 3, showing a standard component seen from the front in vertical section in horizontal section, forming the composite material base facing (1) for the building industry. The facing (1) consists of an outer facing (2) and insulating panel (3) for instance in expanded polystyrene. The insulating panel (3) is bonded for instance by means of hot melt type of adhesive behind the outer facing (2).

This outer face (2) will be of a limited thickness of a few millimeters to several tenths of millimeters and will be made of moulded material preferable polymerised at high pressure to make it resistance, impermeable, rot-proof and self-washable. A selection many naturally be made from all available materials for the most suitable to the building or facing to be produced.

The design of the outer facing (2) is devised to deal with different functions: impermeability, impact resistance, thermal insulation, but also interlocking with adjacent facings. Each facing according to the invention must also be secured to the wall before installation of the adjacent facing masks the securing point.

Each facing (1) used for a cover will thus have an identical structure but will initially be carefully considered with regard to the nature of its materials, dimensions and shapes. As an example hitherto shows a rectangular shape in sketch form which could naturally be quite different, square or polygonal.

On a same wall, there may naturally be a series of different component shapes from the viewpoint of dimensions or the nature of the material composing it but each component must always have a similar structure to that shown in FIG. 1 with a system for interlocking, securing and drainage.

The outer facing (2) shows either a smooth surface, as shown in FIG. 1 giving the appearance of marble or granite, or a structured surface of the appearance of stone, slate or tile.

The outer facing (2) comprises a central zone (4) defined by a top edge (5) and a bottom edge (6). The central part (4) projects in relation to an area (7) located in the upper edge along the whole of the length of the facing. Between the back set zone (7) and the central part of the facing, a groove (8) is provided along the whole of the length of the top edge.

The lower edge (6) also has a minimum height tongue (9) along the whole of its length. Referring to the figures it will be seen that the dimensions of the tongue and of the groove are very small compared with the overall dimensions of the facing (1) but that they are effectively equal.

It is by using minimal height connecting means of that type that a wall insulating cover facing is achieved consisting of several facings assembled with joints of minimal dimension which, at the level of the vertical joints, will have the dimensions of the grooves (8) and of the tongues (9).

Figure 4:
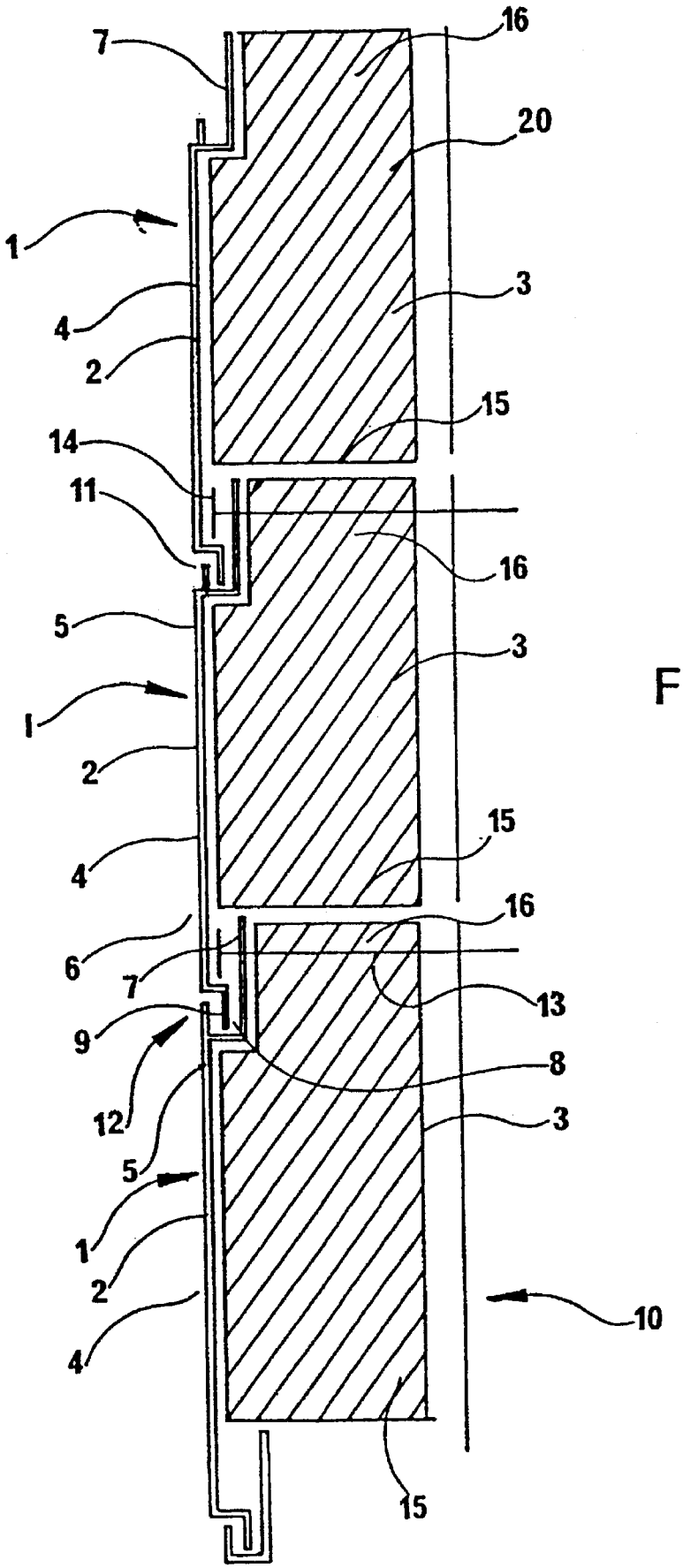
FIG. 4 is a sectional view of an assembled wall insulating facing achieved by means of several composite material facings.

FIG. 4 shows three identical facings for assembly on a wall (10). The central zones (4) have large surfaces compared with the horizontal joints (11 & 12). Each facing (1) is fitted to the wall (10) starting with the lower facings. The first lower facing will be secured to the wall by means of a fastener (13) as shown, which may for instance be a nail or galvanised steel screw secured to polypropylene plugs in the wall. The securing means (13) bear against the top edge (7) and pass through the insulating panel (3). Each facing (1) is thus secured without rail or hook at the upper edge (7) in a zone set back from the surface (4). The head (14) of the securing means becomes invisible as a result of the lower edge of the adjacent facing placed above.

When the lower facing has been correctly placed in position, for instance by means of several screws (13) in its zone (7), the immediately adjacent upper facing can then be installed. The installation is effected for instance at the level of the joint (12) by an interlock on the top edge (5) which will be set back. It will be seen in FIG. 4 how the upper adjacent component is fitted by engaging the tongue (9) in the groove (8). This engaging, along the whole of the length of the facing represents an interlock which allows two adjacent facings to be connected and also allows the connecting means (13) to be concealed. This interlocking allows a good adjustment of the flatness of the facing and the reduction of defects in the support (10).

The securing means to the wall on the facing top edge as well as the groove on the top edge which operates in conjunction with the tongue of the lower edge of the adjacent facing allows securing means to be obtained which are concealed and of small dimension, allowing minimal thickness joints (11 & 12).

The interlocking means and securing means also allow end to end installation of insulating panels (3). In its lower part (15) the insulating panel (3) is achieved along the whole of the thickness of the insulation as selected which may for instance be of 20, 40 or 120 mm. To achieve good thermal insulation, this thickness is maintained along the whole of the height with the exception of a small area (16) representing the area (7) of the upper edge. The back set is minimal and there is no effect on the thermal properties of the cover as whole. Each panel (3) is butted against the adjacent panel so as to place them effectively end to end so that their ends (15 and 16) practically touch and the gap is for instance only of the order of 0 and 4 mm.

Rather than using assemblies or cut-outs at the level of the insulating panels, it is preferable to connect facings in the rigid zones of the outer facings, this construction and implementation being easier installation and achieving an improved surface flatness.

To improve the waterproof property, at the level of the inner surface and before bonding the insulating panels, each outer facing is provided with grooves for instance vertical and at regular intervals. These grooves allow eventual condensation and infiltration water to be discharged. The size of the grooves, their number and pitch will naturally depend largely on the cover as installed. The drainage formed by the network of grooves has not been shown in the drawings. When the securing means and interlocking means for several adjacent components have been installed, to achieve horizontal joints, stops (17) may be used vertically to act in conjunction with a vertical tongue (19) of the adjacent component.

Figure 5:
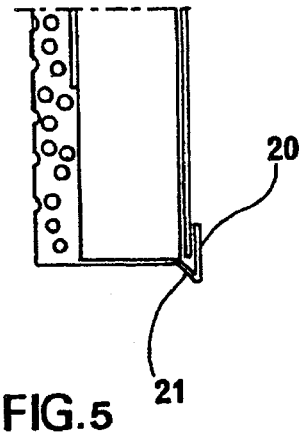
FIG. 5 is a detail view of a composite material facing starting at the level of the lintel.

The drainage network formed by the vertical grooves behind each facing will be discharged as shown in FIG. 5 by a special section (20) with an evacuation aperture (21). Naturally several types of evacuation may be used suiting the configuration of the cover in mind.

As an example an easily installed and assembled cover and insulating panels are assembled on outer facings on a production track in a factory.

Naturally other ways of implementing this invention in the scope of the state of the art may also be considered without going beyond the framework of this invention.

I claim:

1. A composite material facing construction for use in the building industry so as to form a wall facing cover for securing to an existing support comprising:

a first insulating panel having a high pressure polymerized polyester molded outer facing which is rot-proof and self-washable and an expanded polystyrene panel bonded behind said outer facing, said outer facing having a top edge and a bottom edge and side edges extending between said top and bottom edges; and a second insulating panel having a high pressure polymerized polyester molded outer facing which is rot-proof and self-washable and an expanded polystyrene panel bonded behind said outer facing of said second insulating panel, said outer facing of said second insulating panel having a top edge and a bottom edge and side edges extending between said top and bottom edges of said outer facing of said second insulating panel, said top edge of said outer facing of said first insulating panel having a back set interlocking groove means formed therein, said bottom edge of said outer facing of said second insulating panel having a tongue formed thereon, said groove means for engaging said tongue such that said first and second outer facings extend in coplanar relationship, said first insulating panel having a facing securing member extending through said outer facing and said polystryrene panel of said first insulating panel at said top edge of said first insulating panel at said back set interlocking groove means, said tongue of said second insulating panel covering an end of said facing securing member extending outwardly of said outer facing of said first insulating panel such that said end of said facing securing member is invisible from view exterior of said outer facings, said first and second insulating panels abutting each other, and an assembling means formed on the side edges of each of said outer facings of said first and second insulating panels, said assembling means having a stop member formed on one of said side edges and a vertical tongue formed on another side edge, said assembling means for interlocking said outer facings of said first and second insulating panels to a facing of an adjacent insulating panel in waterproof relationship by engaging the stop member with a tongue of the outer facing of the adjacent panel.

2. The facing construction of claim 1, further comprising:

a drainage means formed on an inner face of said outer facing of said first insulating panel for discharging condensation and water from between the outer facing and the polystyrene panel.

3. The facing construction of claim 2, said drainage means comprising a plurality of vertical grooves formed on said inner face.

4. The facing construction of claim 2, said drainage means further comprising a water discharge hole formed in said outer facing at a bottom of said plurality of vertical grooves.

5. The facing construction of claim 1, said top edge of said outer facing of said first insulating panel being juxtaposed against a surface of said outer facing of said second insulating panel so as to conceal the facing securement member.

* * * * *